United States Patent [19]

Peckjian

[11] Patent Number: 4,795,061

[45] Date of Patent: Jan. 3, 1989

[54] APPARATUS FOR PROVIDING WATER AND SYRUP IN A PREDETERMINED RATIO TO A BEVERAGE DISPENSER

[75] Inventor: Bryan M. Peckjian, Philadelphia, Pa.

[73] Assignee: Chilly-Willee Products Div. of Gross-Given Manufacturing Company, Philadelphia, Pa.

[21] Appl. No.: 99,942

[22] Filed: Sep. 23, 1987

[51] Int. Cl.[4] ..... B67D 5/56

[52] U.S. Cl. ..... 222/66; 222/129.2

[58] Field of Search ..... 222/52, 56, 66, 129.1–129.4, 222/135–136, 145, 372, 376, 334; 266/152, 160–161

[56] References Cited

U.S. PATENT DOCUMENTS

| | | | |
|---|---|---|---|
| 3,643,835 | 2/1972 | Popinski | 222/56 |
| 4,160,512 | 7/1979 | Cleland | 222/56 |
| 4,349,130 | 9/1982 | Bair | 222/129.2 |
| 4,467,941 | 8/1984 | Du | 222/1 |
| 4,493,435 | 1/1985 | Hartley | 222/136 X |
| 4,544,328 | 10/1985 | Credle, Jr. | 417/33 |
| 4,703,870 | 11/1987 | Sedam | 222/66 |

OTHER PUBLICATIONS

Photocopy of brochure of Beverage Handling Equipment for "Dispensing Rack".

Photocopy of Brochure of Flojet Showing Dispensing and Proportioning Pumps.

Photocopy of Brochure of SHURflo International Ltd. Showing Proportioning Pump.

Photocopy of Brochure of Scholle Corporation Showing Bag-in-Box Syrup Supply.

Photocopy of brochure of Flojet Corporation Showing Syrup Sold Out Switch Kit, 1985.

*Primary Examiner*—Michael S. Huppert

*Attorney, Agent, or Firm*—Panitch, Schwarze, Jacobs & Nadel

[57] ABSTRACT

An apparatus for providing water and syrup in a predetermined ratio to a beverage dispenser comprises a housing, a source of syrup in a flexible container and a source of water under pressure. A proportioning pump in fluid communication with the syrup source and the water source is provided for receiving syrup and water and for discharging the syrup and water in a predetermined ratio. A water valve, movable between an open and a closed condition, is connected between the water source and the proportioning pump for controlling the flow of water to the pump. The water valve is normally closed, but is opened upon activation of the beverage dispenser, permitting water to flow from the water source to the proportioning pump. Upon receiving the water, the proportioning pump draws syrup from the syrup source and discharges the water and syrup in a predetermined ratio to the beverage dispenser. a vacuum switch, including a sensor, is connected between the syrup container and the proportoning pump. The sensor senses the presence of vacuum in the syrup container, indicating that the syrup in the container has been depleted below a predetermined syrup limit. When the vacuum sensed exceeds a predetermined vacuum limit, the water valve is disabled to prevent water from flowing to the proportioning pump.

10 Claims, 2 Drawing Sheets

APPARATUS FOR PROVIDING WATER AND SYRUP IN A PREDETERMINED RATIO TO A BEVERAGE DISPENSER

BACKGROUND OF THE INVENTION

This invention relates generally to a liquid supply system for a beverage dispenser. More particularly, the present invention comprises an apparatus for providing an undiluted mixture of syrup and water in a predetermined ratio for a beverage dispenser.

A liquid supply system of the general type embodied in the present invention, when used with a beverage dispenser, provides an automated means for operators or consumers to obtain beverages, such as soda, fruit juices, slushes or the like, which are made of a mixture of a predetermined ratio of water and a concentrate or syrup. Generally, it is important that the ratio of the water and syrup remain constant to provide a beverage of a generally consistent, uniform quality. The water flow is usually provided from a source such as a municipal water system and is regulated by a flow meter. The syrup is generally provided from a source such as a syrup container via a syrup pump which may be electrically powered. The beverage dispenser may receive the proportioned syrup and water for immediate mixing and direct dispensing of the beverage in the manner of a soda fountain or bar gun. Alternatively, the beverage dispenser may receive the mixed, proportioned syrup and water and store the mixed liquid in a storage container for display and for dispensing at a later time, in the manner of a juice or slush dispenser. The storage container may include a stirring mechanism to continually or periodically stir or agitate the liquids to maintain a homogeneous mixture.

With both of these types of beverage dispenser, however, problems are often encountered when the syrup source becomes low or depleted. Once the syrup source is low or depleted, little or no syrup enters the pump. If the beverage dispenser is of the type in which the beverage is dispensed directly as it is received from the pump, a diluted beverage or only water is dispensed. If the beverage dispenser is of the type utilizing a liquid storage container, the mixed beverage stored in the container becomes diluted due to the water being added to the container without a corresponding addition of syrup. Therefore, the ratio of syrup to water of the liquid within the storage container slowly becomes more and more disproportionate, each time the liquid supply system attempts to fill the container. In either type of beverage dispenser, the resulting beverage being dispensed is not of a consistent, uniform, acceptable quality. In the case of the direct dispenser, the problem may be noticed by the operator after one or more containers have been filled. In the case of a beverage dispenser with a storage container, the problem may not be noticed by the operator as quickly, particularly with a self-service dispenser, resulting in numerous dissatisfied customers and the need to dispose of the entire contents of the storage container.

A number of prior solutions have been proposed for preventing dispensing of diluted beverage when the syrup source becomes depleted. One such prior art solution involves the use of a float device attached to one end of a rod or string within the syrup container, the other end of the rod or string being attached to a cutoff switch associated with the pump. As the syrup in the container falls below a predetermined level, the float device moves downwardly, actuating the switch to cut off the pump and prevent the pumping of any more syrup. The switch also stops the flow of the water.

A similar prior device uses a float in the syrup container to block the syrup exit opening when the syrup falls below a certain level. The blocking of the exit opening produces a vacuum within the line running from the syrup to the pump to cut off the pump and to stop the flow of the water.

These prior art systems, as well as other prior art systems currently in use, are generally ineffective in that there is generally a significant delay between the time that the syrup supply becomes depleted below a proper operating level and the time that the pump and the water flow are actually cut off. Such a time delay results in the dispensing of watered-down beverages or the dilution of the mixed beverage in the storage container.

The present invention overcomes the problems of the prior art by providing a liquid supply system in which the pump provides both the syrup and the water and is immediately deactivated when a vacuum in excess of a predetermined limit is sensed within the syrup container. The predetermined vacuum limit is established to coincide with the depletion of the syrup within the container below a predetermined syrup limit sufficient to provide the required syrup to the pump to maintain the predetermined water/syrup ratio.

SUMMARY OF THE INVENTION

Briefly stated, the present invention comprises an apparatus for providing water and syrup in a predetermined ratio to a beverage dispenser. The apparatus comprises a housing, a source of syrup in a flexible container and a source of water under pressure. Proportioning pump means are provided in fluid communication with the syrup source and the water source for receiving syrup and water and for discharging the syrup and water in a predetermined ratio. Water valve means, movable between an open and a closed position, are connected between the water source and the pump means for controlling the flow of water from the water source to the pump means. The water valve means is normally closed, but is open upon activation of the beverage dispenser for permitting water to flow from the water source to the pump means. Upon receiving the flow of water, the pump means draws syrup from the syrup container and discharges the water and the syrup in the predetermined ratio to the beverage dispenser. The apparatus further comprises vacuum switch means connected between the syrup container and the pump means. The vacuum switch means includes a sensor means for sensing the presence of a vacuum in the syrup container, indicating that the syrup in the syrup container has been depleted below a predetermined syrup limit. The vacuum switch means also disables the water valve means to prevent water from flowing to the pump means when the sensed vacuum exceeds a predetermined limit.

BRIEF DESCRIPTION OF THE DRAWINGS

The foregoing summary, as well as the following detailed description, will be better understood when read in conjunction with the appended drawings. For the purpose of illustrating the invention, there is shown in the drawings, an embodiment which is presently preferred, it being understood, however, that this invention is not limited to the precise arrangement or instrumentalities shown. In the drawings.

DESCRIPTION OF A PREFERRED EMBODIMENT

Figure 1:
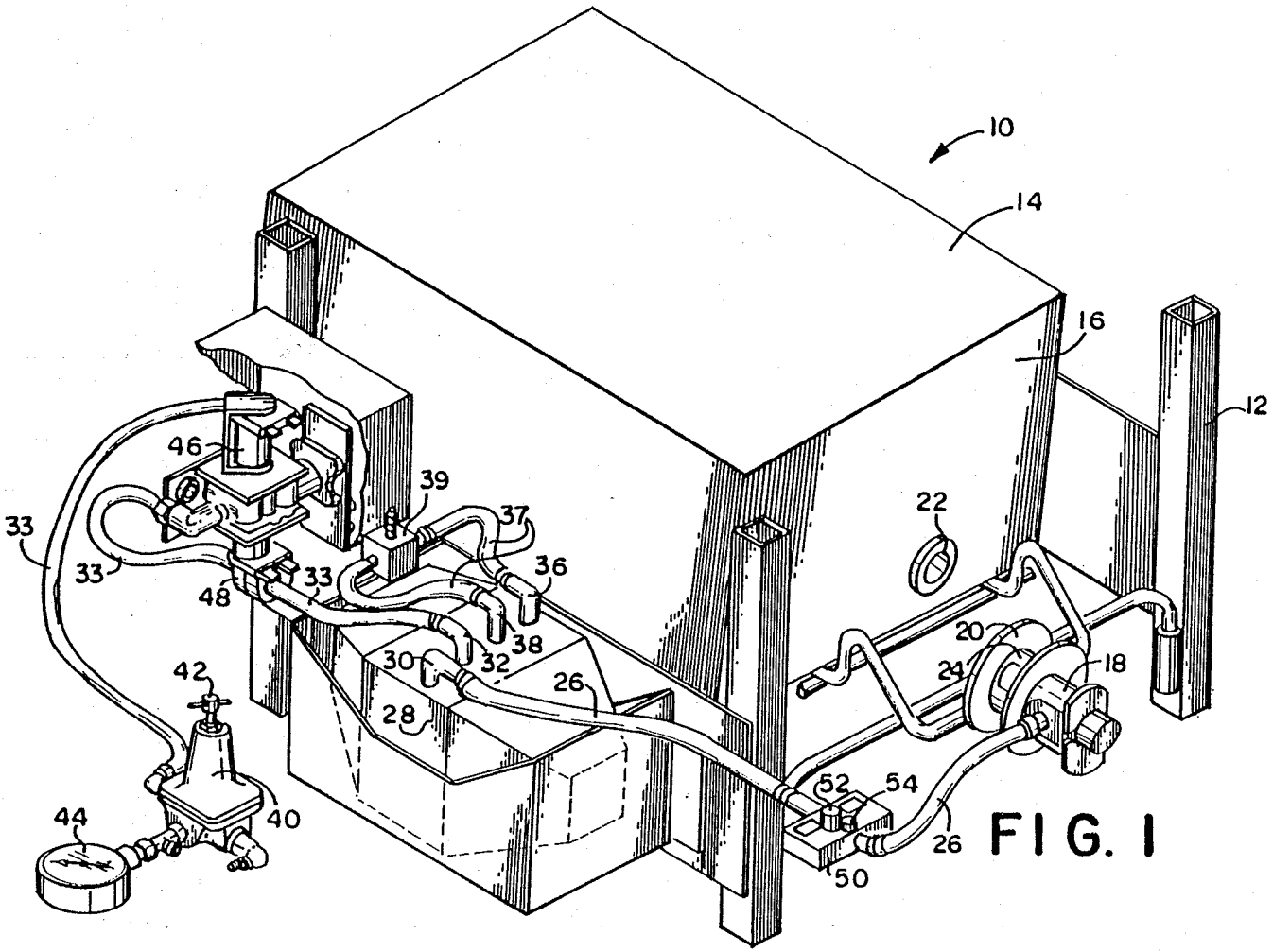
FIG. 1 is a perspective view, partially broken away and partially exploded, of an apparatus for providing water and syrup in a predetermined ratio to a beverage dispenser in accordance with a preferred embodiment of the present invention.
Figure 2:
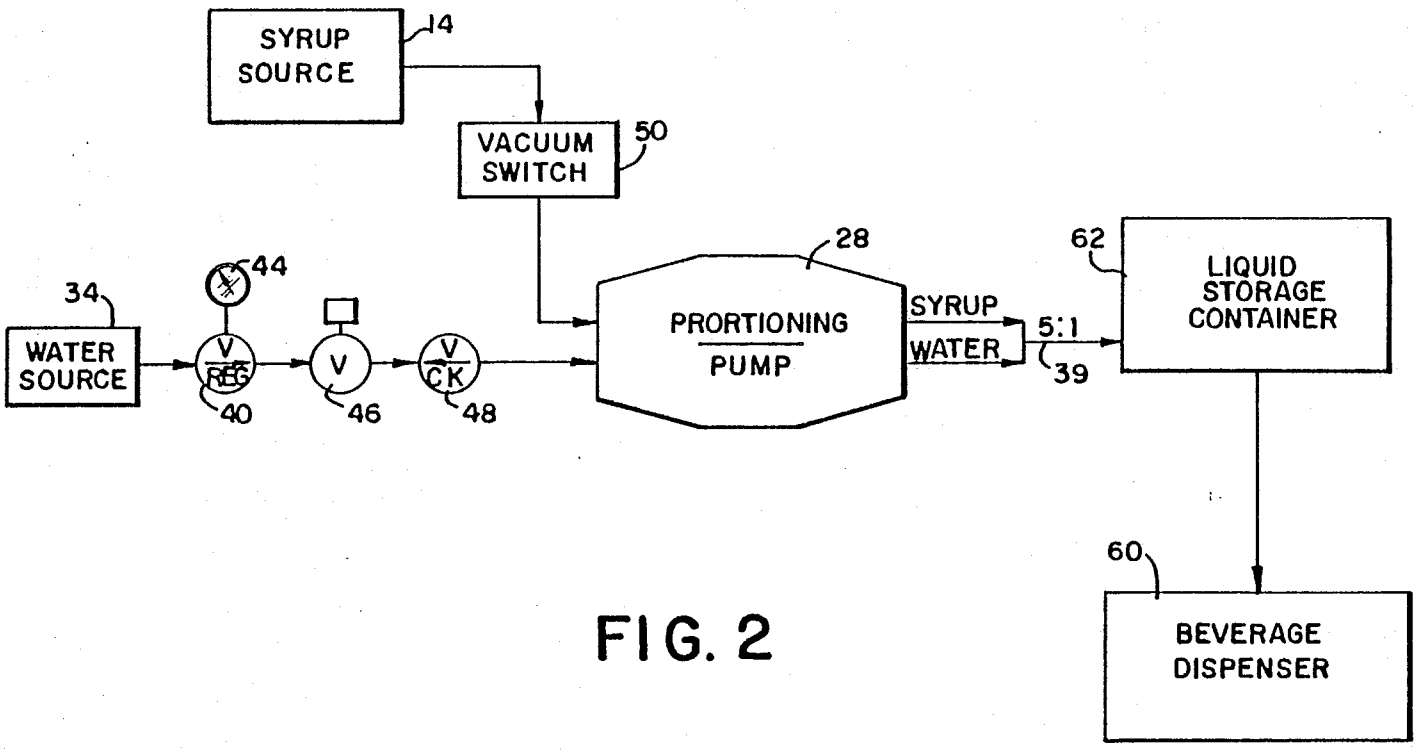
FIG. 2 is a schematic functional block diagram of the apparatus shown in FIG. 1.

Referring in detail to the drawings, where like numerals indicate like elements throughout, there is shown in FIG. 1 a perspective view of a preferred embodiment of an apparatus 10 for providing water and syrup in a predetermined ratio to a beverage dispenser 60 (shown in FIG. 2) in accordance with the present invention. Preferably, the apparatus 10 is employed in conjunction with a beverage dispenser 60 of the type in which syrup and water are combined in a predetermined ratio and are mixed together and stored in a liquid storage container 62 associated with the beverage dispenser 62. An example of such a beverage dispenser 60 which is employed for dispensing such a beverage is shown in U.S. Pat. No. 4,195,754. However, it will be appreciated by those skilled in the art that the present invention could be employed with any other type of beverage dispenser used to dispense any other type of beverage formed of a mixture of water and syrup, whether such beverage dispenser employs a liquid storage container or dispenses the syrup and water mixture directly, for example, a soda fountain or a bar gun in which the water and syrup are mixed as they are dispensed.

The apparatus 10 includes a housing 12 for assembly of the various components in a manner which will hereinafter become apparent. In the present embodiment, the housing is comprised of a generally open frame member or rack 12 generally of a type well known in the art. Racks of this type, which are made of a steel alloy or of some other lightweight, high strength material, are available from Tolle Manufacturing Company, of Marion, Tex. As shown in FIG. 1, some of the components comprising the apparatus 10 are secured to or supported by the sides or outer surfaces of the rack 12, while other components are supported within the confines or inner surfaces of the rack 12. It will be appreciated by those skilled in the art that some form of housing, other than the rack 12, such as a box-like enclosure (not shown) may alternatively be employed in connection with the present invention.

The apparatus 10 further includes a source of syrup, in the present embodiment the syrup being disposed within a syrup container 14. In the present application, the term "syrup" is taken to mean the concentrate or flavoring from which a flavored beverage is formed. Typically, the syrup or concentrate is shipped from its point of manufacture to its point of use and is stored in a conveniently sized container until it is ready to be used. Then, the syrup is mixed with water or, possibly, carbonated water, in a predetermined ratio to provide a beverage having the desired characteristics and quality. The syrup container 14 used in conjunction with the present invention comprises a "bag-in-box" container, a type which is generally well known in the art. The container is comprised generally of a flexible inner bag (not shown) which actually holds the syrup and an outer box-like container 16 which surrounds and protects the flexible inner bag and facilitates handling and storage. As shown in FIG. 1, the syrup container 14 fits within, and is supported by, the frame 12. The syrup container 14 contains a specified quantity of the syrup, preferably five gallons. The flexible inner bag is made of a high strength polymeric material which will not leach into the syrup. The outer container 16 may be made of a heavy cardboard and/or some other suitable lightweight, relatively high strength material. Containers of this type are commercially available from Sholle Corporation, of North Lake, Ill.

A connector assembly 18 is adapted to be secured to one end of the syrup container 14. For this purpose, the connector assembly 18 includes a suitable annular gasket 20 which is adapted to surround and seal a generally circular bushing 22 extending through the syrup container box 16. The connector assembly 18 further includes a cylindrical portion 24 which is adapted to be inserted through the bushing 22 to engage the flexible bag (not shown) within the syrup container 14 to permit the flow of syrup from the syrup container 14 into the connector assembly 18.

A fluid conduit or line, preferably a flexible hose 26, extends from the connector assembly 18 through a vacuum switch means to a syrup input port 30 of a proportioning pump 28. The hose 26 in combination with the connector assembly 18 provides fluid communication between the syrup container 14 and the pump 28 to permit the pump 28 to draw syrup from the syrup container 14 in a manner which will hereinafter become apparent. It will be appreciated by those skilled in the art that the connector assembly 18 functions to assist in providing fluid communication between the syrup container 14 and the pump 28. While, in the presently preferred embodiment, a connector assembly 18 of the type shown and described is preferred, it should be understood that any other means could alternatively be employed for interconnecting the syrup container 14 and the pump 28. For example, the syrup container 14 may include a previously installed, outwardly extending conduit or hose (not shown), the distal end of which could be secured to the syrup input port 30 of the pump 28.

The proportioning pump 28 is of a type well known in the art which is employed for providing a mixture of syrup and water in a predetermined ratio for use by the beverage dispenser. Pumps of this type are commercially available Shurflow Pump Co., of Anaheim, CA. The proportioning pump 28 includes a water input port 32 which is connected, by a suitable flexible conduit or line, such as hose 33, to a source of water under pressure 34 (FIG. 2) in a manner which will hereinafter become apparent. The water source 34 could be a standard water tap connected to a municipal water supply system or any other suitable water source capable of supplying potable water under a pressure of at least about 35 p.s.i.

In the preferred embodiment, the proportioning pump 28 operates by water pressure to pump syrup from the syrup container 14 and to provide an output flow of syrup and water in a predetermined ratio through syrup and water output ports 36 and 38, respectively. The syrup and water output ports 36 and 38, in turn, are both connected via conduit or hoses 37 to a "T" connector 39 within which the syrup and water are mixed. In the preferred embodiment, the desired water/syrup ratio is 5:1, that is, the pump 28 supplies five units of water out of the water output port 38 for every one unit of syrup flowing out of the syrup output port 36. As previously indicated, the precise water/syrup ratio must be maintained in order to provide a beverage having consistent quality.

The pressure of the water flowing to the pump 28 must be maintained at a constant predetermined level. Accordingly, water regulator means, in the present embodiment, a water regulator valve 40 is connected between the water source 34 and the proportioning pump 28. The water regulator valve 40 is of a type well known in the art and commercially available from C. A. Norgren Co., of Littleton, Conn. The water regulator valve 40 includes a valve actuator 42 which may be adjusted by an operator in a manner well known in the art to regulate the pressure of the water flowing to the proportioning pump 28. A standard water pressure gauge or meter 44 is included as part of the water regulator valve 40 to permit the operator to quickly and accurately adjust the water pressure. Preferably, the water-regulating valve is adjustable to provide water to the porportioning pump 28 with a pressure of between 35 p.s.i. and 55 p.s.i.

Water pressure valve means, in the presently preferred embodiment, an electrically activated solenoid valve 46 is also connected between the water source 34 and the proportioning pump 28 for controlling the flow of water therebetween. In the present embodiment, the solenoid valve 46 is of a type well known in the art and commercially available from the Eaton Valve Co., of Carol Stream, Ill. The solenoid valve 46 is normally in a closed condition, but is movable to an open condition upon activation of the solenoid. When the solenoid valve 46 is in the closed condition water is precluded from flowing from the water source 34 to the proportioning pump 28, thereby rendering the proportioning pump 28 inactive. Upon electrical activation of the solenoid, the solenoid valve 46 opens, permitting water under pressure to flow from the water source 34 to the proportioning pump 28, causing the proportioning pump 28 to draw syrup from the syrup container 14 and to discharge the water and syrup in the predetermined ratio from the water and syrup output ports 38 and 36, respectively. The proportioning pump 28 continues to function in this manner until the solenoid valve 46 is closed to stop the flow of pressurized water to the proportioning pump 28.

A check valve 48, of a type well known in the art, is also positioned between the water source 34 and the proportioning pump 28. The check valve 48, which in the present embodiment is a double check valve, operates to prevent syrup or other materials from flowing into the water source 34 from the proportioning pump 28. Check valves of the type employed in the presently preferred embodiment are available from Chudnow Co., of Oceanside, N.Y.

The apparatus 10, as thus far described, is capable of providing water and syrup in a prdetermined ratio to a beverage dispenser 60. The beverage dispenser (not shown in FIG. 1) is suitably connected to the solenoid valve 46 so that when a demand for the syrup and water is encountered, the beverage dispenser generates an electrical signal which is sent to the solenoid valve 46. The solenoid is activated by the electrical signal from the beverage dispenser to open the solenoid valve 46 to provide the pressurized water needed to operate the proportioning pump 28. Such a demand may be generated when a sensor system (not shown) within the beverage dispenser 60 indicates that the liquid within a liquid storage container 62 has fallen below a predetermined level, indicating that the liquid storage container 62 requires filling. Alternatively, in the case of a direct dispensing machine, such a demand may arise by an operator dispensing the beverage into a cup or other container (not shown).

The apparatus 10, as thus far described, provides water and syrup in the predetermined ratio, when demanded, as long as the syrup within the syrup container 14 does not become depleted. A vacuum switch means or vacuum switch 50 is connected between the syrup container 14 and the proportioning pump 28. The vacuum switch 50 includes sensor means (not shown) for sensing the presence of a vacuum within the syrup container 14. As will be appreciated by those skilled in the art, the presence of a vacuum in the syrup container 14 indicates that the syrup has been depleted. Preferably, the sensor means is set to sense a vacuum in the syrup container 14 which exceeds a predetermined limit when the syrup has been depleted below a predetermined syrup limit. The predetermined syrup limit is determined by the minimum amount of syrup necessary to permit sufficient syrup to be withdrawn from the syrup container 14 by the proportioning pump 28 to maintain the predetermined water/syrup ratio. Once the syrup within the syrup container 14 falls below the predetermined syrup limit and the predetermined vacuum limit is exceeded, the vacuum switch disables the solenoid valve 46.

The disabling of the solenoid valve 46 means that the solenoid valve 46 is maintained in its normally closed condition, thereby precluding the flow of water to the proportioning pump 28. As long as the solenoid valve 46 remains disabled, a demand signal from the beverage dispenser is ineffective in opening the solenoid valve 46. The vacuum switch 50 includes indicator means, in the present embodiment, a button 52 to indicate to the operator that the syrup within the syrup container 14 has fallen below the predetermined syrup limit and the vacuum switch 50 has disabled the solenoid valve 46. The operator then knows that the syrup container 14 must be removed and replaced with a new, full syrup container. When a new, full syrup container has been installed, the operator may reset the apparatus 10 by pressing a reset button 54 on the vacuum switch 50. The reset button resets the vacuum switch 50 and again enables the solenoid valve 46.

From the foregoing description, it can be seen that the present invention comprises an apparatus for providing water and syrup in a predetermined ratio to a beverage dispenser. It will be recognized by those skilled in the art that changes may be made to the above-described embodiment of the invention without departing from the broad inventive concepts thereof. It is understood, therefore, that this invention is not limited to the particular embodiment disclosed, but it is intended to cover all modifications which are within the scope and spirit of the invention as defined by the appended claims.

I claim:

1. An apparatus for providing water and syrup in a predetermined ratio to a beverage dispenser comprising:

(a) a housing;

(b) a source of syrup in a flexible container;

(c) a source of water under pressure;

(d) proportioning pump means in fluid communication with the syrup source and the water source for receiving syrup and water and for discharging the syrup and water in a predetermined ratio;

(e) water valve means, movable between an open and a closed condition, connected between the water source and the pump means for controlling the flow of water from the water source to the pump means, the water valve means being normally closed, but being opened upon activation of the beverage dispenser, permitting water to flow from the water source to the pump means, the pump means, when receiving the water, drawing syrup from the syrup source and discharging the water and syrup in the predetermined ratio to the beverage dispenser; and (f) vacuum switch means connected between the syrup container and the pump means, the vacuum switch means including sensor means for sensing the presence of a vacuum in the syrup container indicating that the syrup in the syrup container has been depleted below a predetermined syrup limit and for disabling the water valve means to prevent water from flowing to the pump means when the sensed vacuum exceeds a predetermined limit.

2. The apparatus as recited in claim 1 further comprising water regulator means connected between the water source and the pump means for maintaining the pressure of the water flowing to the pump means at a predetermined level.

3. The apparatus as recited in claim 1 further comprising check valve means connected between the water source and the pump means for preventing back flow of syrup from the pump means to the water source.

4. The apparatus as recited in claim 1 wherein the water valve means comprises an electrically activated solenoid valve.

5. The apparatus as recited in claim 4 wherein the solenoid valve is opened upon receipt of a signal from the beverage dispenser to permit water from the water source to flow to the pump means and is closed when no signal is received from the beverage dispenser or when a signal is received from the vacuum switch means indicating the syrup source is depleted to prevent water from the water source to flow to the pump means.

6. The apparatus as recited in claim 1 further comprising a liquid storage container associated with the beverage dispenser for receiving and storing the predetermined ratio of syrup and water from the pump means.

7. The device of claim 1 wherein direct, uninterrupted vacuum coupling is provided between the sensor means and the flexible container for control of the vacuum switch means directly from vacuum levels within the flexible container.

8. An apparatus for providing water and syrup in a predetermined ratio to a beverage dispenser comprising:

(a) proportioning pump means adapted for fluid coupling with a source of syrup in a flexible container and for separate fluid coupling with a source of water under pressure for receiving syrup and water and for discharging the syrup and water in a predetermined ratio;

(b) water supply conduit means coupled with the pump means and adapted for fluidly coupling the pump means with a source of pressurized water;

(c) syrup supply conduit means coupled with the pump means and adapted for fluidly coupling the pump means with a flexible container source of syrup;

(d) water valve means coupled across the water supply conduit means for connection between the pump means and the water source, the water valve means being movable between an open and a closed condition for controlling the flow of water from the water source to the pump means, the water valve means being normally closed and being opened upon activation by a signal from the beverage dispenser, permitting water to flow from the water source to the pump means, the pump means drawing syrup from the syrup source in response to water flowing through the pump means and discharging the water and syrup in the predetermined ratio to the beverage dispenser; and (e) vacuum switch means coupled with the syrup supply conduit means for direct, uninterrupted vacuum coupling through the syrup supply conduit means to the flexible container, the vacuum switch means including sensor means for sensing the presence of a vacuum in the flexible container indicating that the syrup in the container has been depleted below a predetermined syrup limit, and the vacuum switch means disabling the water valve means to prevent water from flowing to the pump means when the sensed vacuum level in the flexible container exceeds a predetermined limit.

9. The apparatus as recited in claim 7 wherein the water valve means comprises an electrically activated solenoid valve.

10. The apparatus as recited in claim 8 wherein the solenoid valve is opened upon receipt of a signal from the beverage dispenser to permit water from the water source to flow to the pump means and is closed when no signal is received from the beverage dispenser or when a signal is received from the vacuum switch means indicating the syrup source is depleted to prevent water from the water source to flow to the pump means.

* * * * *